United States Patent [19]

Wheless et al.

[11] Patent Number: 5,067,498

[45] Date of Patent: Nov. 26, 1991

[54] TUBE CUTTING AND FORMING APPARATUS

[75] Inventors: Jack C. Wheless, Richmond; Billy J. Keen, Jr., Chesterfield; Renzer R. Ritt, Sr., Richmond, all of Va.

[73] Assignee: Philip Morris Incorporated, New York, N.Y.

[21] Appl. No.: 385,006

[22] Filed: Jul. 25, 1989

[51] Int. Cl.[5] ..... A24C 5/00

[52] U.S. Cl. ..... 131/88; 131/89; 131/91; 131/92; 131/93; 131/94

[58] Field of Search ..... 131/280, 88, 89, 91, 131/93, 94

[56] References Cited

U.S. PATENT DOCUMENTS

| | | |
|---|---|---|
| 1,018,473 | 2/1912 | Auchu . |
| 1,164,118 | 12/1915 | Rogier . |
| 1,446,542 | 2/1923 | Boon . |
| 1,663,542 | 3/1928 | Clyne . |
| 1,761,990 | 6/1930 | Meyers . |
| 1,774,851 | 9/1930 | Stout . |
| 2,156,780 | 5/1939 | Ebert . |
| 2,277,128 | 3/1942 | Miller . |
| 2,322,902 | 6/1943 | Wappler . |
| 2,361,783 | 10/1944 | McLaughlin . |
| 2,372,385 | 3/1945 | Mandell . |
| 2,532,844 | 12/1950 | Hulbert, Sr. et al. . |
| 2,639,646 | 5/1953 | Thompson et al. . |
| 2,898,817 | 8/1959 | Lutz et al. . |
| 3,568,577 | 3/1971 | Voss et al. . |
| 4,369,796 | 1/1983 | Hall . |
| 4,642,083 | 3/1987 | Hinzmann . |

*Primary Examiner*—V. Millin

*Attorney, Agent, or Firm*—Eric M. Lee

[57] ABSTRACT

An apparatus for cutting and forming tubular members useful for positioning heat sources inside a smoking article is disclosed. The tubular members are carried by a plurality of fluted drums from one operation to the next. The tubular members are cut to the desired size by a plurality of rotating circular knives. The ends of the tubular members are then formed by one or more dies that are caused to move into contact with the ends of the tubular members.

20 Claims, 3 Drawing Sheets

TUBE CUTTING AND FORMING APPARATUS

BACKGROUND OF THE INVENTION

This invention relates to an apparatus and method for sizing and shaping paperboard tubes. More particularly this invention relates to an apparatus and method for forming tubes useful for positioning heat sources inside a smoking article such as described in co-pending application serial number 07/223,153. These so-called "generator tubes" typically are standard paperboard tubes and are about 17 millimeters long, about 7 millimeters in diameter with a wall thickness of about 0.5 millimeters. Such tubes are preferably coated with a thin layer of aluminum foil.

Devices exist for cutting tubular members or for forming the ends of tubular members or for cutting and forming tubular members. However, these devices are not entirely satisfory for cutting and forming tubular members of small dimensions as are required for use as "generator tubes." These devices are not capable of cutting the aluminum lined tubes to satisfactory narrow tolerances. Moreover such devices are not capable of forming the ends of the tube to the desired shape without destroying the thin inner and outer lining of aluminum foil. Finally, such devices are not capable of operating at sufficiently high speeds for the efficient and economical production of large quantities of cut and formed tubular members.

In view of the foregoing, it would be desirable to provide a tube cutting and forming apparatus that is capable of cutting tubular members of small dimensions to specified narrow tolerances.

It would also be desirable to provide a tube cutting and forming apparatus that is capable of forming the ends of a tubular member lined with a thin inner and outer layer of aluminum foil without destroying the lining of aluminum.

It would still further be desirable to provide a tube cutting and forming apparatus that is capable of operating at high speeds to provide large quantities of cut and formed tubular members.

SUMMARY OF THE INVENTION

It is therefore an object of this invention to provide a tube cutting and forming apparatus that is capable of cutting tubular members of small dimensions to specified narrow tolerances.

It is another object of this invention to provide a tube cutting and forming apparatus that is capable of forming the ends of a tubular member lined with a thin inner and outer layer of aluminum foil without destroying the lining of aluminum.

It is still another object of this invention to provide a tube cutting and forming apparatus that is capable of operating at high speeds to provide large quantities of cut and formed tubular members.

In accordance with the invention, there is provided an apparatus comprising a plurality of fluted drums to hold paperboard tubes during cutting and forming operations and to properly align and transport the tubes from one operation to the next. Initially the tubes are transferred from a hopper by a feed drum to a cutting drum where the ends of the tube are cut off and the tube is then cut in half. The cut tubes are then transferred onto a grade drum which picks up the tubes one at a time from the cutting drum so that only one tube is located in each flute of the grade drum. Next the tubes are transferred onto an align drum. The grade drum and align drum have guides to properly align the tubes in each flute of the align drum. The tubes are then transferred to a first die drum which partially rolls back the ends of the tube. A second die drum then completely rolls back the ends of the tube. Dies associated with each end of each flute of each die drum slide toward the ends of the tube by means of a cam mechanism to roll back the ends of the tube. The final operation is to cut the formed tube in half.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTIONS

Figure 1:
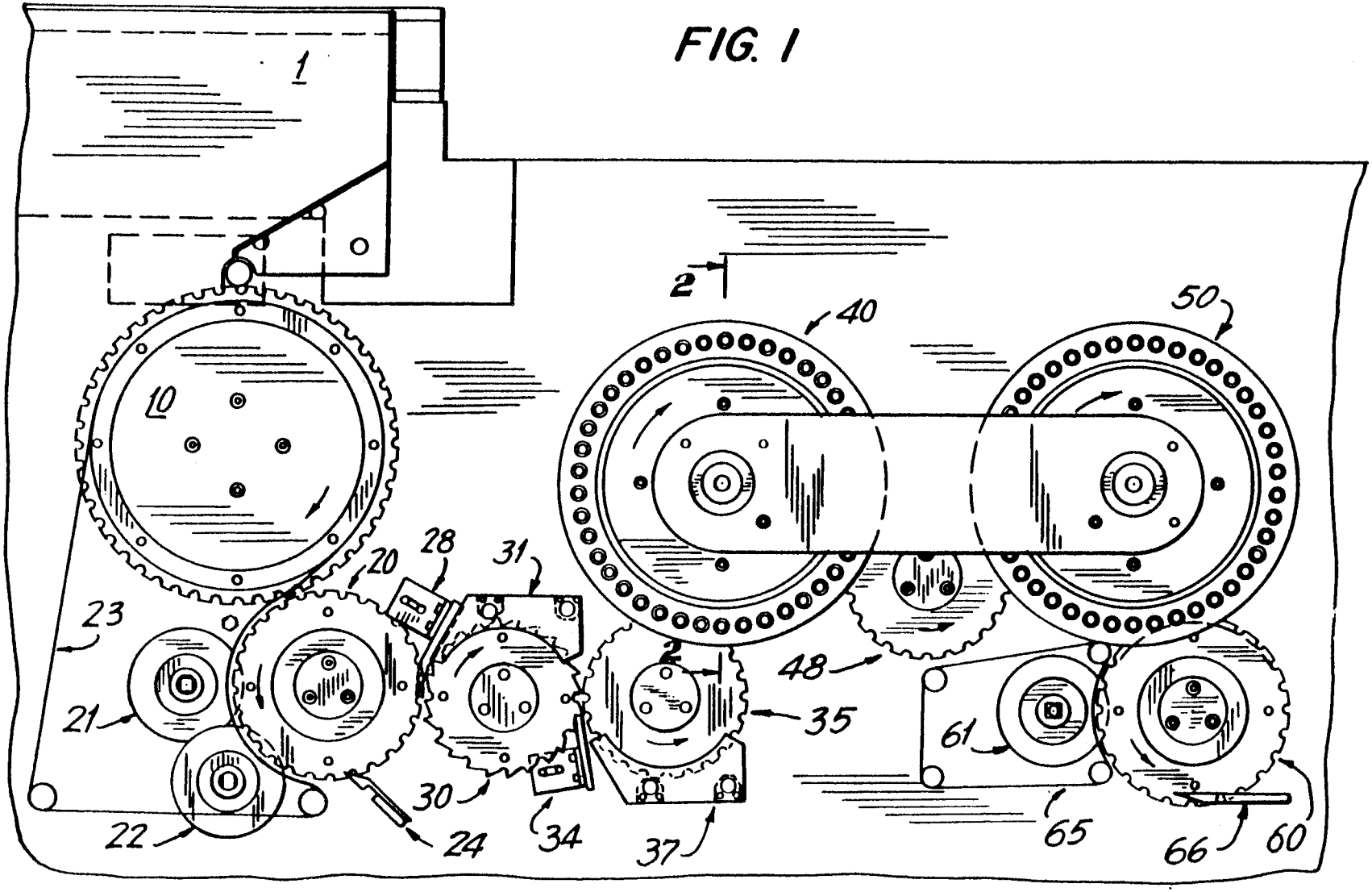
FIG. 1 is a schematic front elevation view of the apparatus of this invention.

The tubes provided to the apparatus of the invention are typically about 85 to about 90 millimeters in length and about 7 millimeters in diameter. They are standard laminated paperboard having a thin inner and outer layer of aluminum foil.

The tubes to be shaped and cut are stored in the hopper 1 for delivery to the apparatus of the invention where various cutting, aligning and forming operations are performed on the tubes. These tubes are picked up from the hopper via a feed drum 10. Feed drum 10 is a fluted rotary drum preferably about 12 inches in diameter and preferably having 48 flutes. The flutes are sized to hold only one tube therein. Feed drum 10 is fitted with a standard vacuum valve mount allowing the vacuum to operate within feed drum 10. Each flute of feed drum 10 is provided with one or more air flow passages through which the vacuum may operate. In this way, each tube is held securely in place by means of the vacuum.

Feed drum 10 preferably rotates clockwise at about 26 rpm. The tubes are thus carried around feed drum 10 and are transferred to cut drum 20 which preferably rotates counter clockwise. Cut drum 20 is preferably positioned about 9.5 inches from feed drum 10 center to center. Cut drum 20 is preferably about 7 inches in diameter preferably having 28flutes. Again each flute is sized to hold only one tube. Cut drum 20 is also fitted with a standard vacuum valve mount which is in fluid communication with air flow passages in each of the flutes to hold each tube in the flutes of cut drum 20.

Two sets of standard rotary knives 21 and 22 are preferably used in connection with cut drum 20 to cut the tubes in the flutes. Each knife engages cut drum 20 and extends into cut drum 20 at least a distance equal to the depth of each flute through an annular ring around cut drum 20. This arrangement ensures a clean cut through the entire diameter of each tube.

First rotary knife 21 is preferably aligned to cut each tube in half. The center of first rotary knife 21 is preferably located on the same horizontal axis as the center of cut drum 20 and is preferably about 4 inches in diameter. First rotary knife 21 also preferably rotates at about 1000 rpm.

Preferably a second set of rotary knives 22 is employed after first rotary knife 21 and is aligned to cut off the outside ends of the tube that have just been cut in half by first rotary knife 21. This is desirable in order to present a tube cut to precise tolerances for forming as described hereinafter.

The center of second set of rotary knives 22 is preferably located on the same side of cut drum 20 as first rotary knife 21 and on a line extending from the center of cut drum 20 that is about 45 degrees below the horizontal. Each of these rotary knives is preferably about 4 inches in diameter and preferably rotates at about 1000 rpm. Of course the knives could be arranged to first cut off the ends of the tube and then cut the tube in half.

A guide means may be placed along the side of cut drum 20 where the two sets of rotary drums are located. In one embodiment, the guide means is comprised of two metal plates. Each metal plate extends around about one half of the circumference of cut drum 20. One end of each metal plate extends into the area where feed drum 10 and cut drum 20 are closest together. Feed drum 10 has at least one annular space ring extending around its circumference. The annular space ring extends at least to the depth of the lowest point of each of the flutes on feed drum 10 but does not interfere with the air flow passages of the flutes. With this arrangement, one end of one of the metal plates can extend into the annular space ring to facilitate the removal of the tubes from feed drum 10 and transfer the tubes onto cut drum 20. Thus, as the tubes travel with rotating feed drum 10 toward cut drum 20 the tubes will come in contact with the metal plate extending into the annular space ring and will be urged out of the flutes of feed drum 10 and into the flutes of cut drum 20. Each metal plate, in addition to the vacuum employed, then serves to hold the tubes in the flutes of cut drum 20. Each metal plate should be arranged along the width of cut drum 20 so as not to interfere with the two sets of rotary knives while still holding the tubes in place on cut drum 20.

In an alternative and preferred embodiment, two belts 23 are preferably used as guide means. Each belt 23 travels around a portion of the circumference of feed drum 10 in annular spaces provided around the circumference of feed drum 10. These annular spaces extend at least to the lowest point of each flute on feed drum 10. At about the point where feed drum 10 and cut drum 20 are the closest together, each belt 23 travels from feed drum 10 around cut drum 20 adjacent to where rotary knives 21 and 22 are located. This arrangement causes the tubes to be lifted from the flutes of feed drum 10 and transferred into the flutes of cut drum 20. Belts 23 then serve to aid the vacuum in holding the tubes in the flutes of cut drum 20, while the tubes are being cut. Each belt 23 should be close enough to cut drum 20 to hold the tubes in the flutes of cut drum 20 while the tubes are being cut. Belts 23 should also be arranged so that each belt 23 holds one half of the tube after the tube is cut. Preferably belts 23 travel at a speed equal to the surface speed of the tubes in the cut drum 20.

The air flow passages of each flute of cut drum 20 are arranged to be in fluid communication with each half of the tube but not with the ends of the tube that have been cut off. This allows the ends of the tube that have been cut to fall away while the remaining halves stay securely in the flutes. Alternatively, plates 24 may be aligned to contact the ends of the tube that have been cut to remove the cut ends from the flutes.

After cut drum 20, the next operation is for the tube halves to be aligned before they are transferred onto die drums 40 and 50. Alignment may be achieved by one or more align drums. The align drums again are preferably fitted with standard vacuum valve mounts which are in fluid communication with air flow passages in the flutes to hold each tube in each flute by means of a vacuum suction. Again, each flute is sized to hold only one tube therein. In the preferred embodiment, two such align drums 30 and 35 are used. However one drum or more than two drums could also be used.

The first align drum is a grade drum 30 which preferably rotates in a clockwise direction. Grade drum 30 picks up each half of the cut tube one at a time so that there is only one tube, now about one half of the length of the tubes supplied from hopper 1, in each flute. In order to do this, grade drum 30 rotates faster than cut drum 20. Preferably grade drum 30 rotates twice as fast as cut drum 20, i.e., at about 100 rpm. Grade drum 30 is also preferably about 5½ inches in diameter and preferably has 24 flutes. A removal means 28 is preferably located adjacent to the point where grade drum 30 and cut drum 20 are closest together. Removal means 28 extends to cut drum 20 and into an annular space extending around the circumference of cut drum 20 and at least to the lowest point of each flute on cut drum 20. This allows removal means 28 to urge the tube away from the flutes of cut drum 20 and into a flute on grade drum 30. The prongs that are used by removal means 28 to remove the tubes from the flutes of cut drum 20 are preferably oriented so that one prong engages one half of the cut tube before the second prong engages the other half of the cut tube. In this way, one half of the cut tube will be removed from the flute of cut drum 20 before the other half of the cut tube. Also, rotating grade drum 30 faster than cut drum 20 ensures that each half of the cut tube will be transferred to a separate flute in grade drum 30. Grade drum 30 is preferably a saw tooth drum which further facilitates the transfer of the tubes from cut drum 20 to grade drum 30.

Guide means 31 may be comprised of two plates positioned adjacent to grade drum 30. The plates are not parallel and are placed so that they are angled toward each other in the direction of rotation of grade drum 30. The preferred angle is about 5 degrees. The plates extend far enough toward grade drum 30 so that the tubes located in the flutes of grade drum 30 will contact the plates. The tubes will thus be urged into alignment one behind the other from one flute to the next. If one align drum is used, guide means 31 should ensure that the tubes are all properly aligned after they engage the plates. Also, if one align drum is used, it should have a large enough diameter to ensure that the angle of the plates is not too steep. If the angle is too steep, the plates could knock the tubes off of the align drum instead of properly aligning the tubes. If more than one align drum is used, then it is necessary that the tubes be properly aligned after engagement with the plates of the last align drum.

In the preferred embodiment, the tubes are transferred to a second align drum 35 after passing through the plates of guide means 31 associated with grade drum 30. Align drum 35 is preferably about 6 inches in diameter, preferably has 24 flutes and preferably rotates at about 100 rpm. Align drum 35 is also preferably located on the same horizontal axis as grade drum 30 as shown in FIG. 1. Grade drum 30 and align drum 35 are preferably about 6 inches apart center to center. A removing means 34 is located adjacent to where grade drum 30 and align drum 35 are closest together. Removing means 34 preferably has two prongs extending into annular spaces extending around the circumference of grade drum 30 and at least to the lowest point of each of the flutes of grade drum 30. These prongs are used to remove the tubes from the flutes of grade drum 30 and transfer them into the flutes of align drum 35. Align drum 35 preferably rotates counter clockwise.

Guide means 37 comprising two plates are positioned adjacent to align drum 35. These plates are not parallel and are placed so that they are angled toward each other in the direction of the rotation of align drum 35. The preferred angle is about 5 degrees. These plates are positioned close enough to align drum 35 so that the tubes will engage with these plates. The tubes will thus be urged into alignment one behind the other from one flute to the next.

Once the tubes are properly aligned they are then transferred onto at least one die drum. One or more die drums can be used to fold back the ends of the tube. The portion of the tube that is folded back serves to hold the heat source in place in a smoking article that uses a heat source and an aerosol generator such as described in co-pending application Ser. No. 07/223,153. Preferably the ends of the tubes are folded back in two operations performed on two separate die drums.

In the preferred embodiment two die drums are used. The die drums are rotating fluted drums. Again the flutes are sized to hold only one tube. The first die drum 40 preferably rotates clockwise. First die drum 40 has a standard vacuum valve mount which is in fluid communication with air flow passages in the flutes of first die drum 40. The tubes are transferred onto first die drum 40 from align drum 35 by ensuring that the vacuum on align drum 35 is not exerted on the tubes at the point of transfer to first die drum 40. This is accomplished by not having the vacuum in align drum 35 in fluid communication with the flutes that move past the point where the tubes are transferred to first die drum 40. In this manner, the vacuum of first die drum 40 will pull the tubes from align drum 35 into the flutes of first die drum 40.

First die drum 40 preferably has 42 flutes and rotates at about 60 rpm. First die drum 40 also is preferably about 102 inches in diameter and about 8.25 inches from align drum 35 center to center. The center of first die drum 40 is preferably located on a line extending from the center of align drum 35 about 25 degrees to the right of vertical as shown in FIG. 1.

Figure 2:
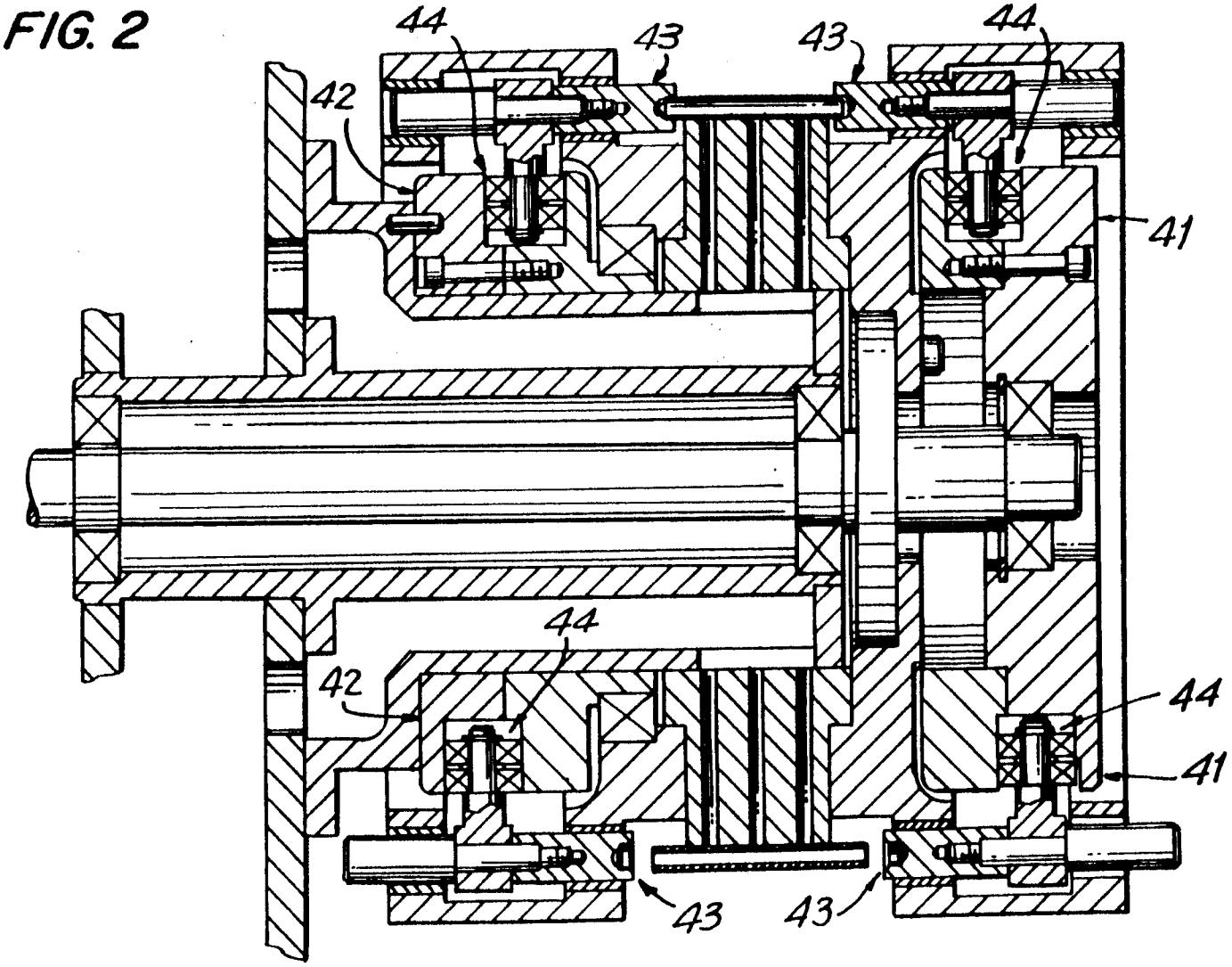
FIG. 2 is a cross section of the die drum of this invention taken along line 2—2 of FIG. 1 with the align drum deleted for clarity.

On both sides of first die drum 40, there are cams 41 and 42 and preferably 42 dies connected to followers 44 that engage cams 41 and 42. Followers 44 and associated dies 43 rotate with first die drum 40 but cams 41 and 42 do not. As shown in FIG. 2, cams 41 and 42 are shaped to provide a path for followers 44 to move toward the center of the flute and then back to the outside of the flute. Thus, as first die drum 40 rotates, followers 44 follow the path provided by cams 41 and 42 causing dies 43 on opposite sides of first die drum 40 to move toward each other and then away from each other. Cams 41 and 42 should be arranged so that followers 44 and associated dies 43 are farthest apart at the point where the tubes are transferred from align drum 35 onto first die drum 40.

Belts (not shown) or other means to hold the tubes in the flutes of first die drum 40 are preferably used in conjunction with the vacuum. The belts preferably extend only over the center of the tubes in the area where the tubes are subjected to the force of dies 43. This ensures that the tubes are held tightly in the flutes so the tubes remain properly aligned when dies 43 fold back the ends of the tubes. The belts also prevent the tubes from sticking in one of the dies once the forming operation is complete.

Figure 3:
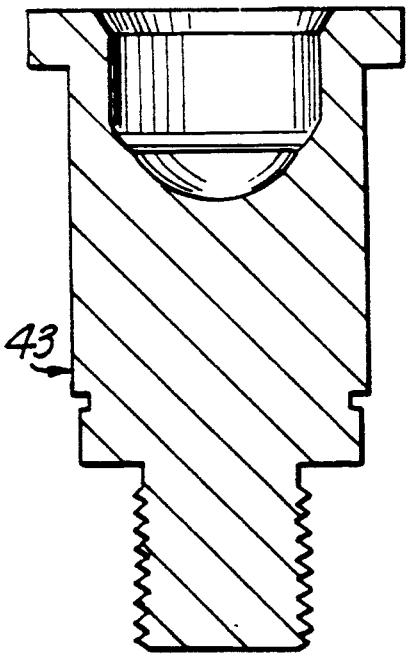
FIG. 3 is an enlarged cross-sectional view of a die used in the first die drum of FIG. 2.

Die 43 used in first die drum 40 preferably has a configuration as shown in FIG. 3. Die 43 is shaped to partially roll back the edges of the tube. The specific dimensions for the first die will vary depending upon the size of the tube to be shaped. For the tube formed with the apparatus of this invention die 43 should roll the ends of the tube to about a 0.062 inch radius bend. This slight rolling will facilitate the complete turning of the ends on second die drum 50. By rolling back the ends of the tube in two separate operations the integrity of the tube is maintained and there is no danger that the tube or aluminum foil lining will be destroyed by the rolling operation. The entrance to the die should also be flaired outwardly at about 30 degrees for ease of insertion of the tube.

After the tubes are subjected to this initial rolling operation, the tubes are then transferred to second die drum 50. A transfer drum 48 is used to carry the tubes from first die drum 40 to second die drum 50. Transfer drum 48 is a rotating fluted drum having flutes sized to fit only one tube. Transfer drum 48 preferably rotates counter clockwise and preferably travels at about 100 rpm. It preferably has 24 flutes and preferably is about 6 inches in diameter. Transfer drum 48 is also equipped with a standard vacuum valve mount which is in fluid communication with air flow passages formed in the flutes of transfer drum 48 to hold the tubes in the flutes. The transfer of the tubes from first die drum 40 to transfer drum 48 is accomplished by ensuring that the vacuum in first die drum 40 is not exerted in the flutes of first die drum 40 that move past the point where the tubes are transferred to transfer drum 48. Thus, the vacuum of transfer drum 48 pulls the tubes from first die drum 40 into the flutes of transfer drum 48.

As transfer drum 48 rotates it transfers the tubes to second die drum 50. This transfer is accomplished by synchronizing the effect of the vacuum of transfer drum 48 and second die drum 50 as described in connection with the transfer of tubes from align drum 35 to first die drum 40 and from first die drum 40 to transfer drum 48.

Second die drum 50 is identical in operation to first die drum 40 but for the shape of the die used. Thus the cams on second die drum 50 should be arranged so that the dies are the farthest apart at the point where the tubes are transferred to second die drum 50. Belts (not shown) preferably extend over the center of the tubes in the area where the dies are pressed against the ends of the tubes. This helps hold the tubes in the flutes of second die drum 50 in conjunction with the vacuum.

Figure 4:
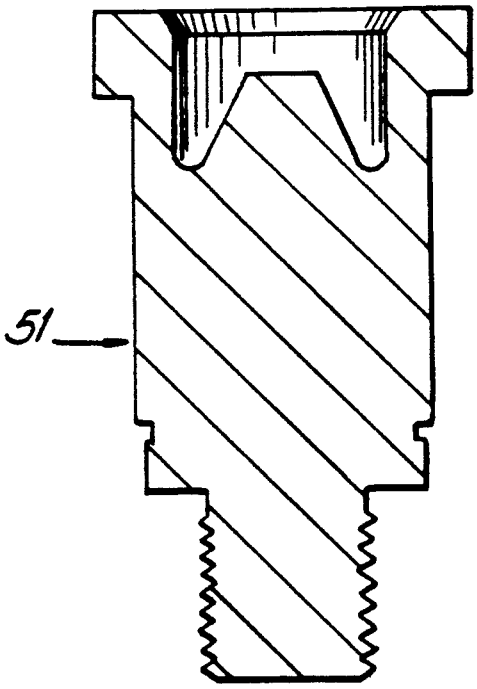
FIG. 4 is an enlarged cross-sectional view of another die used in the second die drum of FIG. 2.

As illustrated in FIG. 4, the die 51 used in second die drum 50 has an annular space into which the partially rolled tube is inserted. The bottom of this annular space has a radius of curvature of between about 0.017 inches and about 0.025 inches so that the inner wall of the annular space is at an angle of about 25 degrees from the outer wall. This configuration ensures that -the ends- of the tube-are rolled back to a point where a carbon heat-source- can be inserted and held in place by the folded back ends of the tube. The depth of the annular space can be varied depending on the length of the tube and the length of the folded back ends desired. Also, the entrance to this annular space should be flared outwardly at about 30 degrees to allow for easy insertion of the tube.

The force at which the dies fold over ends of the tube should be less than the force it takes to destroy the integrity of the tube. If the forming force is larger the tube will be destroyed by the forming process. One means of reducing the force at which the dies must push against the ends of the tube to be formed is to weaken that end of the tube. This can be done by scoring the end of the tube in a direction parallel to the longitudinal axis of the tube for the length of the tube that is to be folded back. In order to achieve this effect, a serrated ring can be placed along the inner wall of die 43 used on first die drum 40. Alternatively the inner wall of dies 43 used in connection with first die drum 40 can be formed with serrations. The serrations should be sharp in order to score the tube along the desired length. Of course, another die drum that would score the ends of the tube could be added before first die drum 40.

After the final forming operation the tubes are transferred onto a second cut drum 60 to cut the formed tubes in half. Second cut drum 60 is a rotating fluted drum having flutes sized to hold only one tube. Preferably second cut drum 60 is about 8.75 inches from second die drum 50 center to center and the center of second cut drum 50 is positioned on a line extending from the center of second die drum 50 about 15 degrees to the right of the vertical as shown in FIG. 1. Second cut drum 60 is preferably about 7 inches in diameter with 28 flutes. Second cut drum 60 preferably rotates at about 90 rpm.

Second cut drum 60 is equipped with a standard vacuum valve mount. This vacuum valve mount is in fluid communication with air flow passages formed in each flute to hold the tubes in the flutes by means of the vacuum. Transfer between the drums is accomplished, as described before, by synchronizing the effect of the vacuum at the point where the tubes are transferred from second die drum 50 to second cut drum 60.

A standard rotary knife 61 is associated with second cut drum 60. To ensure a clean cut through the entire tube, rotary knife 61 extends into an annular space extending around the circumference of second cut drum 60 and at least to the lowest point of the flutes of second cut drum 60. Rotary knife 61 is preferably positioned about 5.125 inches from second cut drum 60 center to center and is preferably about 4 inches in diameter. Rotary knife 61 preferably rotates at about 1500 rpm.

Holding means such as guide plates (not shown) extend around second cut drum 60 at least through the point where rotary knife 61 engages the tubes. This close proximity helps to hold the tubes in place during the cutting operation to ensure an accurate cut. Alternatively and preferably belt means 65 is used as the holding means. These belts, one on each side of knife 61, extend around cut drum 60 only in the area where knife 61 cuts the tube. This helps to hold the tubes during the cutting operation without interfering with other parts of the apparatus.

Finally a removal means 66 is provided to remove the tubes from second cut drum 60. Prongs associated with removal means 66 extend into annular spaces extending around the circumference of second cut drum 60 at least to the lowest point of the flutes. In this way, the prongs will urge the cut tubes out of the flutes as second cut drum 60 rotates past removal means 66.

Thus it can be seen that a tube cutting and forming apparatus is provided that cuts the tubes to specified narrow tolerances, forms the ends of the tube without destroying the aluminum lining and operates at high speeds. One skilled in the art will appreciate that the present invention can be practiced by other than the described embodiments, which are presented for purposes of illustration and not of limitation, and the present invention is limited only by the claims which follow.

What is claimed is:

1. An apparatus for cutting and subsequently forming the ends of a tube, comprising:

transferring means for transferring said tubes to be cut and formed from a hopper means to a first cutting operation;

first cutting means adjacent to said transferring means for receiving said tubes from said transferring means and for cutting said tubes;

aligning means adjacent to said first cutting means for receiving portions of said cut tubes from said first cutting means and for aligning said portions of said cut tubes in a particular orientation;

forming means adjacent to said aligning means for receiving said portions of said cut tubes from said aligning means for forming the ends of said portions of said cut tubes; and second cutting means adjacent to said forming means for receiving said portions of said cut tubes from said aligning means for again cutting said portions of said cut tubes.

2. The apparatus of claim 1 wherein said transferring means is a rotating fluted drum having at least one belt extending around a portion of the circumference of said rotating fluted drum and located above the lowest point of the flutes at about the point where said tubes are transferred to said first cutting means to facilitate the removal of said tubes from said transferring means to said cutting means.

3. The apparatus of claim 2 wherein said first cutting means comprises a second rotating fluted drum for carrying said tubes past at least one rotating knife.

4. The apparatus of claim 3 wherein said at least one belt further extends around a portion of the circumference of said second rotating fluted drum for holding said tubes securely in the flutes of said second rotating fluted drum as said tubes travel past said at least one rotating knife.

5. The apparatus of claim 4 wherein said aligning means comprises a third rotating fluted drum for receiving each of said cut tubes from said second rotating fluted drum wherein only one portion of said cut tubes is received in each flute of said third rotating fluted drum.

6. The apparatus of claim 5 wherein said aligning means further comprises guide means associated with said third rotating fluted drum for urging said portions of said cut tubes into a desired alignment.

7. The apparatus of claim 6 wherein said aligning means further comprises a fourth rotating fluted drum having guide means associated therewith for urging said portions of said cut tubes into a desired alignment.

8. The apparatus of claim 7 wherein said forming means comprises a fifth rotating fluted drum having die means associated therewith for rolling back the ends of said portions of said cut tubes.

9. The apparatus of claim 8 wherein said die means has one die associated with each end of each flute of said fifth rotating fluted drum that are alternately urged toward the center of each of said flutes to contact and form the ends of said portions of said cut tubes) and then back toward the end of said flutes out of engagement with said tubes.

10. The apparatus of claim 9 further comprising a second belt means extending over a portion of the circumference of said fifth rotating fluted drum to hold said cut tubes in the flutes of said fifth rotating fluted drum.

11. The apparatus of claim 8 wherein said forming means further comprises a sixth rotating fluted drum having die means associated therewith, wherein a first die means associated with each flute of said fifth rotating fluted drum partially rolls back the ends of said portions of said cut tubes and a second die means associated with each flute of said sixth rotating fluted drum completely rolls back the ends of said tubes.

12. The apparatus of claim 11 further comprising a third belt means extending over a portion of the circumference of said sixth rotating fluted drum to hold said cut tubes in the flutes of said sixth rotating fluted drum.

13. The apparatus of claim 11 wherein said second cutting means comprises a seventh rotating fluted drum for carrying said portions of said cut tubes past at least one rotating knife.

14. The apparatus of claim 13 further comprising a fourth belt means extending over a portion of the circumference of said seventh rotating fluted drum to hold said cut tubes in the flutes of said seventh rotating fluted drum.

15. The apparatus of claim 11 wherein said first die means engages the ends of each portion of said cut tubes to-form about a 0.062 inch radius curvature for the ends of each portion of said cut tubes and said second die means engages the partially formed ends of each portion of said cut tubes to form between about a 0.017 inch and about a 0.025 inch radius of curvature for the ends of each portion of said cut tubes.

16. An apparatus for forming the ends of a tube, comprising:

a first rotating fluted drum having a first die associated with each end of each flute of said first rotating fluted drum that is alternately urged toward the center of each flute of said first rotating fluted drum and then back toward the end of each flute f said first rotating fluted drum wherein said die engages the ends of said tubes to form about a 0.062 inch radius of curvature for the ends of said tubes;

a second rotating fluted drum having a second die associated with each end of each flute of said second rotating fluted drum that is alternately urged toward the center of each flute of said second rotating fluted drum and then back toward the end of each flute of said second rotating fluted drum (wherein said second die engages the partially formed ends of said tubes to form between about a 0.017 inch and about a 0.025 inch radius of curvature for the ends of said tubes; and)

a transferring means for transferring said tubes from said first rotating fluted drum to said second rotating fluted drum and wherein said transferring means is located between said first rotating fluted drum and said second rotating fluted drum.

17. An apparatus for forming the ends of a tube comprising:

a first rotating fluted drum having a first die associated with each end of each flute of said first rotating fluted drum that is alternately urged toward the center of each flute or said first rotating fluted drum and then back toward the end of each flute of said first rotating fluted drum to partially roll back the ends of said tubes, a second rotating fluted drum having a second die associated with each end of each flute of said second rotating fluted drum that is alternately urged toward the center of each flute of said second rotating fluted drum and then back toward the end of each flute of said second rotating fluted drum to completely roll back the ends of said tubes; and a transferring means for transferring said tubes from said first rotating fluted drum to said second rotating fluted drum and wherein said transferring means is located between said first rotating fluted drum and said second rotating fluted drum.

18. The apparatus of claim 1 wherein said forming means comprises:

a first rotating fluted drum having a first die associated with each end of each flute of said first rotating fluted drum that is alternately urged toward the center of each flute of said first rotating fluted drum and then back toward the end of each flute of said first rotating fluted drum to partially roll back the ends of said portions of said cut tubes;

a second rotating fluted drum having a second die associated with each end of each flute of said second rotating fluted drum that is alternately urged toward the center of each flute of said second rotating fluted drum and then back toward the end of each flute of said second rotating fluted drum to completely roll back the ends of said portions of said cut tubes; and a transferring means for transferring said portions of said cut portions of said cut tubes from said first rotating fluted drum to said second rotating fluted drum and wherein said transferring means is located between said first rotating fluted drum and said second rotating fluted drum.

19. The apparatus of claim 18 wherein said first die engages the ends of said portions of said cut tubes to form about a 0.062 inch radius of curvature for the ends of said portion of said cut tubes.

20. The apparatus of either of claims 18 or 19 wherein said second die engages the ends of the partially formed ends of said portions of said cut tubes to form between about a 0.017 inch and about a 0.025 radius of curvature for the ends of said portions of said cut tubes.

* * * * *